United States Patent [19]

Tsubata

[11] Patent Number: 4,467,840

[45] Date of Patent: Aug. 28, 1984

[54] WOVEN SLIDE FASTENER STRINGER AND APPARATUS FOR MANUFACTURING THE SAME

[75] Inventor: Noritaka Tsubata, Uozu, Japan

[73] Assignee: Yoshida Kogyo K. K., Tokyo, Japan

[21] Appl. No.: 330,382

[22] Filed: Dec. 14, 1981

[30] Foreign Application Priority Data

Dec. 18, 1980 [JP] Japan ..... 55-179485

[51] Int. Cl.[3] ..... D03D 1/00; A44B 19/34

[52] U.S. Cl. ..... 139/384 B; 24/392

[58] Field of Search ..... 139/384 B, 384 R, 116; 24/205.1 C, 205.13 C, 205.16 C, 392, 393

[56] References Cited

U.S. PATENT DOCUMENTS

| | | | |
|---|---|---|---|
| 4,191,220 | 3/1980 | Yoshida | 139/384 B |
| 4,210,180 | 7/1980 | Tsubata | 139/384 B |
| 4,254,803 | 3/1981 | Tsubata | 139/384 B |
| 4,381,804 | 5/1983 | Griessbaum | 139/384 B |
| 4,383,558 | 5/1983 | Tsubata et al. | 139/384 B |

*Primary Examiner*—James Kee Chi

*Attorney, Agent, or Firm*—Hill, Van Santen, Steadman & Simpson

[57] ABSTRACT

A woven slide fastener stringer comprises a row of filamentary coupling elements fastened to a stringer tape by a binding thread system composed of weft and warp threads intertwined with the coupling elements and the stringer tape. At leat a pair of warp threads symmetrically overlie and underlie upper and lower legs of the coupling elements and cross each other between adjacent coupling elements. The weft threads of the binding thread system are interlooped with the symmetrically running warp threads at the upper and lower legs of the coupling elements. With such an arrangement, coupling heads connected to the coupling element legs are disposed substantially perpendicularly to the plane of the stringer tape for increased coupling strength necessary to keep opposite rows of coupling elements securely interengaged against accidental separation. An apparatus for manufacturing such a woven slide fastener stringer includes independent heddles and filling inserters for supplying warp and weft threads of such a binding thread system.

5 Claims, 10 Drawing Figures

FIG. 9 PRIOR PROBLEM
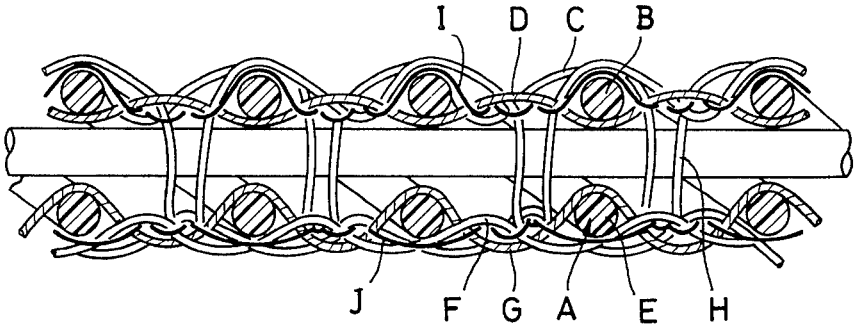
FIG. 10
PRIOR PROBLEM
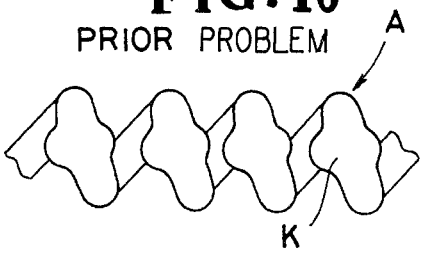

WOVEN SLIDE FASTENER STRINGER AND APPARATUS FOR MANUFACTURING THE SAME

BACKGROUND OF THE INVENTION

1. Field of the Invention

The present invention relates to a woven slide fastener stringer having a row of continuous filamentary coupling elements woven integrally into a stringer tape.

2. Prior Art

Various woven slide fastener stringers and apparatus for manufacturing the same have been proposed and used in the art. Such a woven slide fastener stringer includes a row of coiled or meandering coupling elements of synthetic resin which are woven into and fixed to a longitudinal edge portion of a stringer tape as the coupling elements are formed of a filamentary material. Some woven slide fastener stringers have been found to be unsatisfactory in that a binding thread system which fastens the coupling elements to the stringer tape forces upper and lower legs of the coupling elements toward each other to a point where coupling heads are inclined with respect to the plane of the stringer tape. The coupling heads thus formed fail to provide a sufficient coupling strength when opposite rows of coupling elements on stringer tapes are brought into interdigitating engagement with each other.

SUMMARY OF THE INVENTION

A binding thread system which fixes a row of continuous filamentary coupling elements to a longitudinal edge portion of a stringer tape includes at least a pair of binding warp threads disposed adjacent to coupling heads of the coupling elements and alternately overlying and underlying legs of the coupling elements which extend from the coupling heads. The binding warp threads run symmetrically and cross each other obliquely or parallel to a direction substantially normal to the plane of the stringer tape, the crossing points being located between adjacent coupling elements. The binding warp threads have loops interlaced with loops of a weft thread which form the stringer tape. The binding warp system also includes a weft thread having loops interlaced with the loops of the binding warp threads.

It is an object of the present invention to provide a woven slide fastener stringer including a row of coupling elements fixedly secured to a stringer tape and having coupling heads, respectively, extending substantially perpendicularly to the plane of the stringer tape for an increased degree of coupling strength when a pair of such slide fastener stringers are mated together.

Many other objects, advantages and features of the present invention will become manifest to those versed in the art upon making reference to the detailed description and the accompanying sheets of drawings in which preferred embodiments incorporating the principles of the present invention are shown by way of illustrative example.

BRIEF DESCRIPTION OF THE DRAWINGS

FIG. 9 is an enlarged schematic cross-sectional view of woven slide fastener stringer; and FIG. 10 is an enlarged front elevational view of a distorted row of coupling elements of the woven slide fastener stringer illustrated in FIG. 9 showing the problem.

DETAILED DESCRIPTION

As shown in FIGS. 9 and 10, my earlier woven slide fastener stringer disclosed in Japanese Laid-Open Patent Publication No. 56-116403, published on Sept. 12, 1981, comprises a row of coupling elements A each having a pair of upper and lower legs B, E, and a binding thread system that fixes the row of coupling elements A to a stringer tape (not shown). The binding thread system includes warp threads C, D running over and under the upper legs B, warp threads F, G underlying and overlying the lower legs E, a warp thread H extending vertically between adjacent coupling elements A, and weft threads I, J having loops interlaced with these warp threads. The binding thread system tends to press the upper legs B downwardly and the lower legs E upwardly to a point where coupling heads K (FIG. 10) and inclined with respect to the plane of the stringer tape. With such an arrangement, the coupling heads K provide a weaker coupling strength when opposite rows of coupling elements are interengaged than do the coupling heads of filamentary coupling elements sewn to a stringer tape. It has been found that the larger the size of slide fasteners, the greater the tendency for confronting coupling heads or fastener stringers to fail to produce a sufficient degree of coupling strength when they are coupled together.

The present invention is described with reference to FIGS. 1 through 8.

Figure 3:
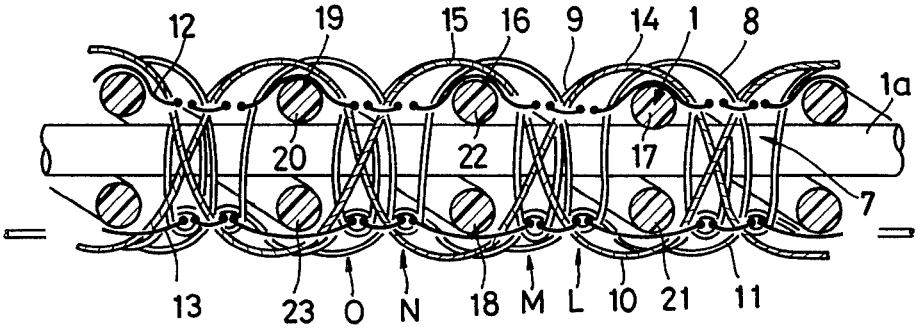
FIG. 3 appearing with FIG. 1, is a cross-sectional view taken along line III—III of FIG. 2.
Figure 2:
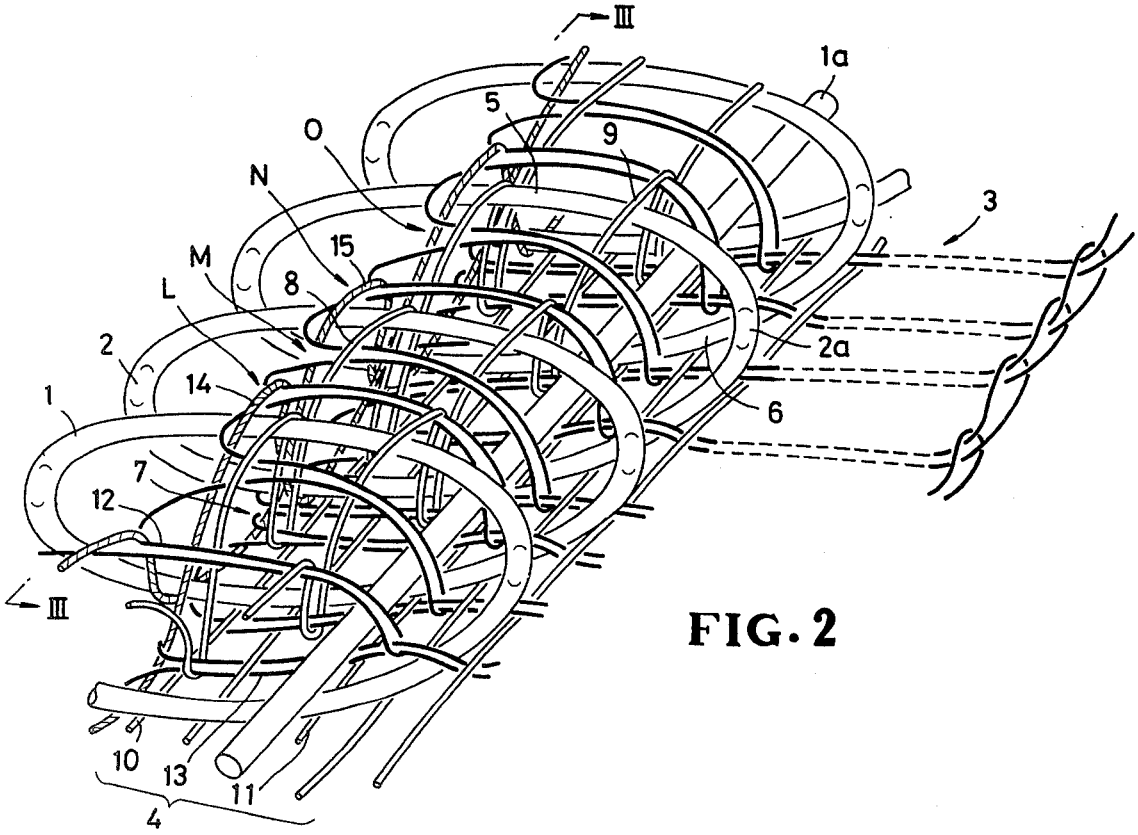
FIG. 2 is an enlarged schematic perspective view of a woven slide fastener stringer according to the present invention.

In FIGS. 2 and 3, a woven slide fastener stringer according to an embodiment of the present invention comprises a row of coiled coupling elements 1 formed of synthetic resin fixed to a slide fastener stringer tape 3 woven of weft and warp threads, the row of coupling elements 1 extending along a longitudinal edge portion 4 of the stringer tape 3. The row of coupling elements 1 is secured to the stringer tape 3 by means of a binding thread system 7 including a pair of upper warp threads 8, 9, a pair of lower warp threads 10, 11, an upper weft thread 12, a lower weft thread 13, and a pair of binding warp threads 14, 15.

Each of the coupling elements 1 comprises a coupling head 2 projecting transversely beyond the longitudinal edge portion 4 of the stringer tape 3, and a pair of upper and lower legs 5, 6 (FIG. 2) extending from the coupling head 2 over and across the longitudinal tape edge portion 4 and spaced from each other vertically in a direction substantially perpendicular to the plane of the stringer tape 3. The upper and lower legs 5, 6 are blended into and interconnected by a heel portion 2a located remotely from the coupling head 2. The lower legs 6 of the coupling elements 1 are mounted on the longitudinal edge portion 4 of the stringer tape 3. A longitudinal core cord 1a extends through a space defined through the coiled coupling elements 1 and is positioned closer to the heel portions 2a than to the coupling heads 2 as best shown in FIG. 2.

The binding warp threads 14, 15 of the binding thread system 7 are intertwined with the upper and lower legs 5, 6 of the coupling elements 1 at a position adjacent to the coupling heads 2. As best illustrated in FIG. 3, the binding warp thread 14 alternately overlies and underlies the upper and lower legs of the adjacent coupling elements 1. More specifically, the binding warp thread 14 overlies an upper leg 17 of one of the coupling elements 1, underlies a lower leg 18 of an adjacent coupling element 16, and again overlies an upper leg 20 of an adjacent coupling element 19, and so on. Likewise, the binding warp thread 15 underlies a lower leg 21 of said one of the coupling elements 1, overlies an upper leg 22 of the adjacent coupling element 16, and underlies a lower leg 23 of the adjacent coupling element 19. Thus, the binding warp threads 14, 15 run symmetrically in a vertical sense with respect to a horizontal line parallel to the plane of the stringer tape 3. The binding warp threads 14, 15 cross each other obliquely with respect to the direction normal to the plane of the stringer tape 3 at positions between adjacent coupling elements.

The binding warp thread 14 thus extending along an undulated path has a plurality of upper loops running over the upper legs and a plurality of lower loops running under the lower legs. Similarly, the binding warp thread 15 has a plurality of lower loops running under the lower legs and a plurality of upper loops running over the upper legs. The upper weft thread 12 is interlooped with the upper loops of the binding warp thread 14 such that the upper weft thread 12 is located inwardly of the upper loops of the warp thread 14 at points L, N, and outwardly of such upper loops at points M, O. Stated otherwise, the upper weft thread 12 has a plurality of loops each interlaced with a corresponding one of the upper loops of the binding warp thread 14. The upper weft thread 12 also includes a plurality of loops which are interlooped with the lower weft thread 13 adjacent to the heel portions 2a of the coupling elements 1.

Likewise, the lower weft thread 13 is interlooped with the lower loops of the binding warp thread 15 such that the lower weft thread 13 is located inwardly of the lower loops of the warp thread 15 at the points L, N, and outwardly of such lower loops at the points M, O. The lower weft thread 13 thus has a plurality of loops each interlaced with a corresponding one of the lower loops of the binding warp thread 15. The lower weft thread 13 also extends into the stringer tape 3 as shown in FIG. 2 in which the weft thread 13 cooperates with warp threads in making up the stringer tape 3.

The warp threads 8, 9 of the binding thread system 7 overlie the upper legs of the coupling elements and are interlooped with the lower weft thread 13 between the adjacent coupling elements. The warp threads 10, 11 of the binding thread system 7 are interwoven with the lower weft thread 13.

Figure 1:
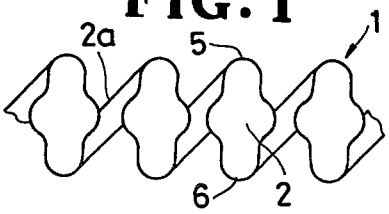
FIG. 1 is an enlarged front elevational view of a row of coupling elements of a woven slide fastener stringer according to the present invention.

With the arrangement described above, the binding warp threads 14, 15 extend around the upper and lower legs of the coupling elements in a symmetrical pattern as best shown in FIG. 3, so that the coupling heads 2 extend perpendicularly to a direction in which the coupling elements extend, as shown in FIG. 1, or to the plane of the stringer tape 3. The coupling heads 2 thus arranged provide a sufficient degree of coupling strength which enables opposite rows of coupling elements to mesh with each other firmly against the danger of getting accidentally separated.

Figure 5:
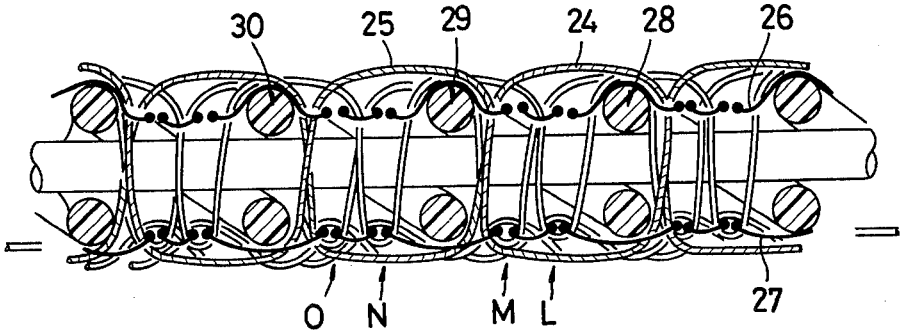
FIG. 5 appearing with FIG. 1, is a cross-sectional view taken along line V—V of FIG. 4.
Figure 4:
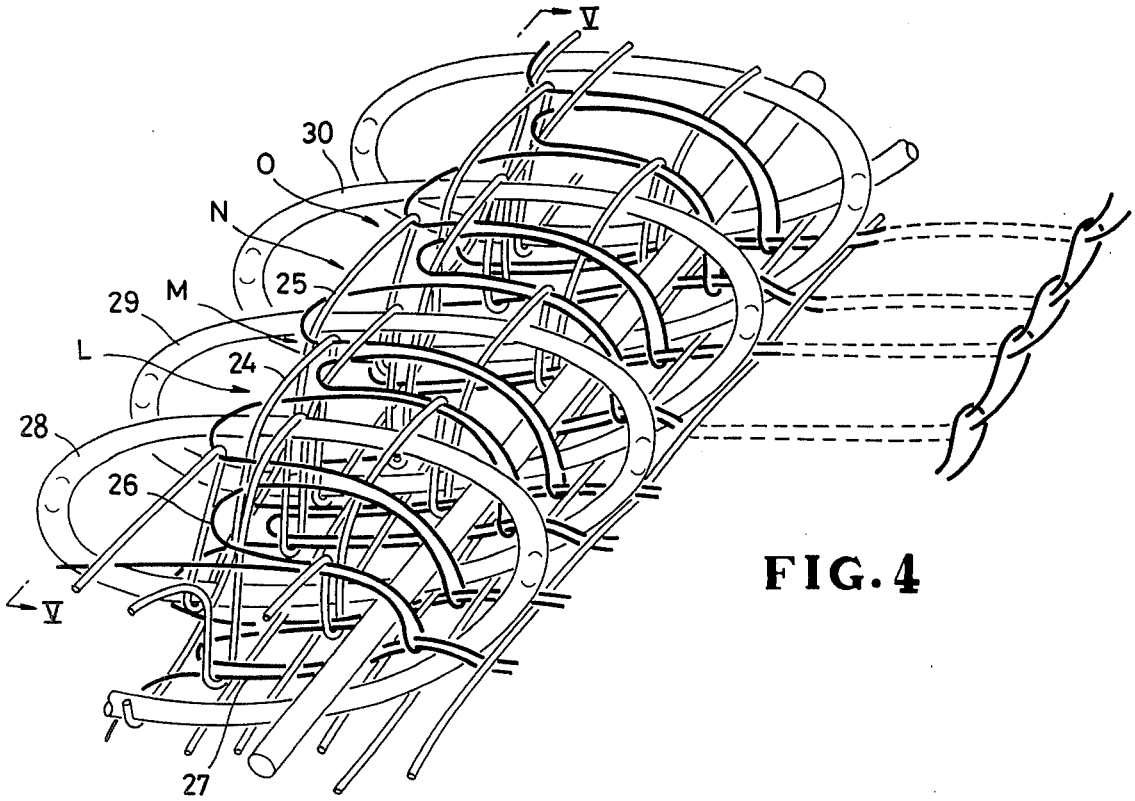
FIG. 4 is an enlarged schematic perspective view of a woven slide fastener stringer according to another embodiment.

A woven slide fastener stringer according to another embodiment shown in FIGS. 4 and 5 includes a binding thread system having a pair of binding warp threads 24, 25 and upper and lower weft threads 26, 27 which are interlooped with the binding warp threads 24, 25 in a pattern different from that illustrated in FIGS. 2 and 3. More specifically, the upper and lower weft threads 26, 27 are disposed inwardly of loops of the binding warp threads 24, 25 at points L, M, N, O such that the upper and lower weft threads 26, 27 have loops each interlaced with two adjacent loops of the binding warp threads 24, 25. Thus, the binding warp threads 24, 25 cross each other between adjacent coupling elements 28, 29, 30 (FIG. 5) in a direction substantially perpendicular to the plane of a stringer tape of the slide fastener stringer, or parallel to a direction in which upper and lower legs of the coupling elements 28, 29, 30 are spaced from each other. The upper and lower legs of the coupling elements are thus fastened by the binding warp threads 24, 25, enabling coupling heads connected to the couplelement legs to retain a position closer to a perpendicular to the plane of the stringer tape.

Figure 6:
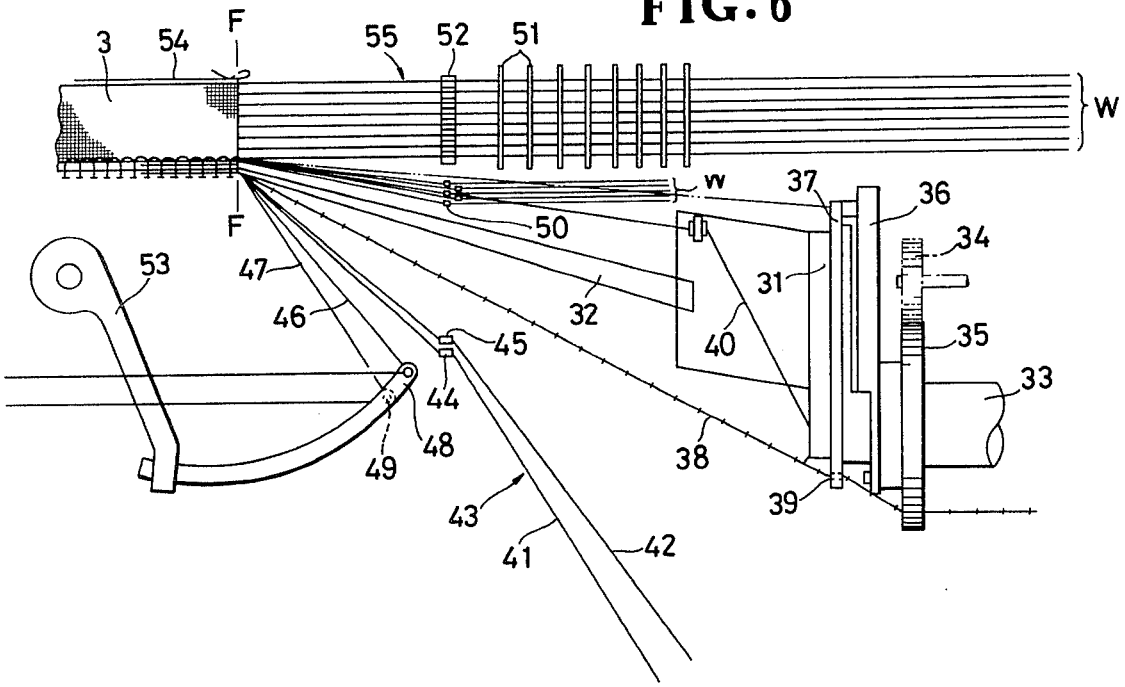
FIG. 6 is a schematic plan view of an apparatus for manufacturing a woven slide fastener stringer.

FIG. 6 illustrates an apparatus for manufacturing a woven slide fastener stringer according to the present invention. The apparatus comprises a loom 55 for weaving a stringer tape 3 of warp threads W progressively at a fell F, the loom 55 including heddle frames 51 for selectively moving the warp threads W up and down, a reed 52 for beating a weft thread inserted in a shed between separated warp threads W against the fell F, and a knitting needle 54 reciprocably disposed alongside of the stringer tape 3 for successively knitting loops of the weft thread projecting out of the warp shed to form a tape selvage.

The apparatus also includes a support 31 positioned alongside of the warp threads W, a mandrel 32 fixed to the support 31 and extending to the fell F, an annular rotor 37 rotatably mounted on the support 31 and having a guide hole 39 for passage therethrough of an element-forming filamentary material 38 of synthetic resin, the rotor 37 being drivable for rotation by a drive mechanism 36 operatively coupled to a follower gear 35 held in mesh with a driven gear 34 connected to a motor (not shown) and rotatably mounted on a fixed shaft 33 disposed in eccentric relation to the rotor 37. When the rotor 37 is rotated, it coils the filamentary material 38 in a conical orbital path around the mandrel 32 into a row of coupling elements as they are woven into the stringer tape 3 in synchronization with the weaving of the latter.

A pair of heddles 44, 45 (best shown in FIGS. 7 and 8) is disposed in opposite relation to the warp threads W across the mandrel 32 and they are vertically movable individually for supplying a pair of binding warp threads 41, 42 along a path 43 extending toward the fell F onto the coupling elements as formed to fasten the latter to the stringer tape 3.

A pair of filling carriers or weft inserters 48, 49 is positioned alongside of the mandrel 32 and is supported by an actuator arm 53 angularly movable back and forth to swing the filling carriers 48, 49 in unison along an arcuate path. One of the filling carriers 48 carries an upper weft thread 46 and the other filling carrier 49 carries a lower weft thread 47, the upper and lower weft threads 46, 47 when inserted being engageable with the binding warp threads 41, 42 to fix the coupling elements in position on the stringer tape 3. A plurality of heddles 50 selectively move warp threads w up and down which also serve to bind the coupling elements on the stringer tape 3.

The support 31 and the fixed shaft 33 have holes for feeding therethrough a core cord 40 into a space defined through the coupling elements as the latter are successively produced.

Figure 7:
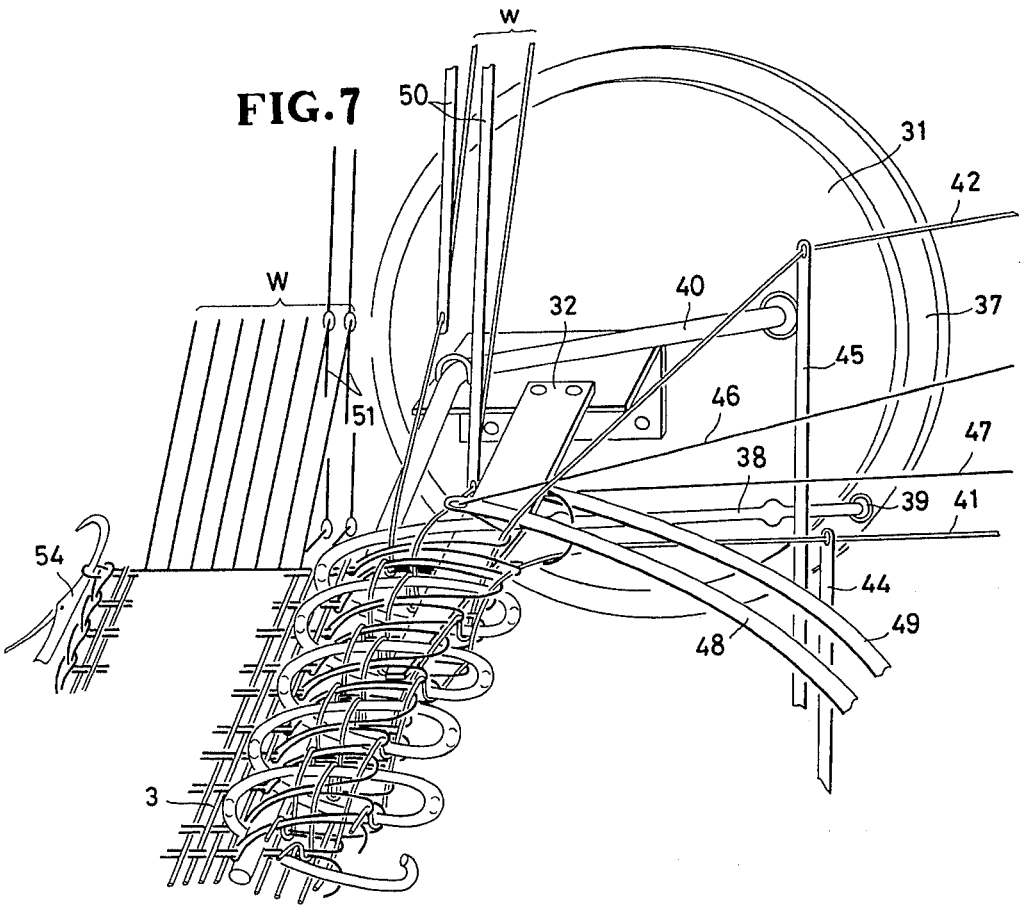
FIGS. 7 and 8 are enlarged schematic perspective views of the apparatus shown in FIG. 6, the views showing different parts positions while the apparatus is in operation to produce a woven slide fastener stringer.
Figure 8:
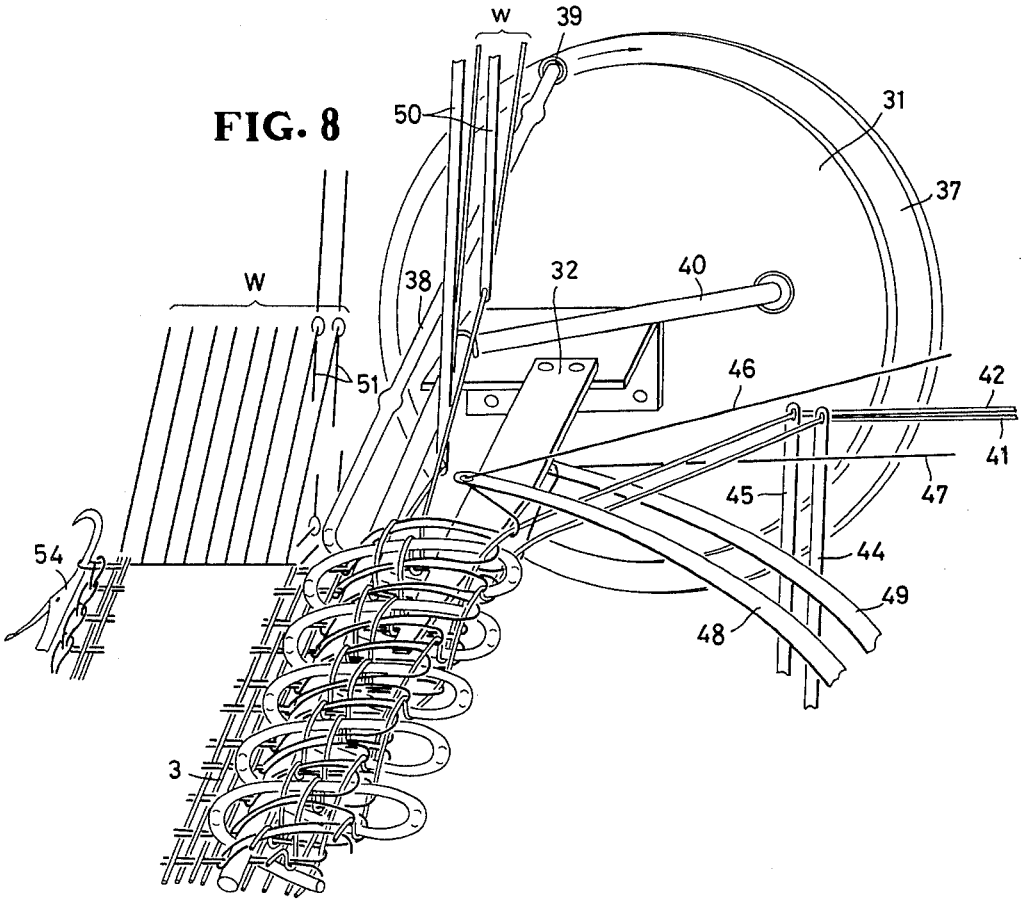

In operation, the annular rotor 37 rotates to coil the filamentary material 38 around the mandrel 32 as shown in FIGS. 7 and 8 to form a succession of coupling elements as they are fastened to the stringer tape 3 by a binding thread system that is composed of the warp threads 41, 42 supplied from the heddles 44, 45, the warp threads w supplied from the heddles 50, and the upper and lower weft threads 46, 47 fed by the filling carriers 48, 49 over and under the coupling elements where the weft threads 46, 47 are interlaced with the warp threads 41, 42, and the warp threads w. FIG. 7 shows the position of the parts taken just before the stringer is woven at the point L (FIGS. 2 and 3), and FIG. 8 shows the position which the parts assume immediately before the stringer is woven at the point M (FIGS. 2 and 3).

With the apparatus thus arranged, the binding warp threads and weft threads of a binding thread system can be supplied from the heddles and filling carrier of their own which are simple in structure and located adjacent to the other parts of the apparatus without involving modifications therein.

Although various minor modifications might be suggested by those versed in the art, it should be understood that I wish to embody within the scope of the patent warranted hereon, all such embodiments as reasonably come within the scope of my contribution to the art.

I claim as my invention:

1. A woven slide fastener stringer comprising:

(a) a woven stringer tape having a longitudinal edge portion including a first weft thread having a plurality of first loops disposed along said longitudinal edge portion;

(b) a row of continuous filamentary coupling elements disposed on said longitudinal edge portion and spaced longitudinally from each other, each of said coupling elements including a coupling head projecting transversely beyond said longitudinal edge portion and a pair of first and second legs extending from said coupling head and spaced from each other in a direction substantially perpendicular to the plane of said longitudinal edge portion, said first legs being mounted on said longitudinal edge portion; and (c) a binding thread system fixing said rows of continuous filamentary coupling elements and including at least a pair of warp threads disposed adjacent to said coupling heads and alternately overlying and underlying said first and second legs of the coupling elements in symmetrical relation substantially with respect to the plane of the longitudinal edge portion, said pair of warp threads having loops interlaced with said first loops of the first weft thread of the longitudinal edge portion adjacent to said first legs, and a second weft thread having a plurality of second loops arranged longitudinally of said binding thread system and interlaced with said loops of said pair of warp threads adjacent to said second legs.

2. A woven slide fastener stringer according to claim 1, said pair of warp threads crossing each other obliquely with respect to said direction at positions between adjacent coupling elements.

3. A woven slide fastener stringer according to claim 2, each of said first and second loops of said first and second weft threads being interlooped with a corresponding one of said pair of warp threads.

4. A woven slide fastener stringer according to claim 1, said pair of warp threads crossing each other substantially parallel to said direction at positions between adjacent coupling elements.

5. A woven slide fastener stringer according to claim 4, each of said first and second loops of said first and second weft threads being interlooped with two adjacent loops of said pair of warp threads.

* * * * *